US005106222A

United States Patent [19]

D'Amore

[11] Patent Number: 5,106,222

[45] Date of Patent: Apr. 21, 1992

[54] EMBOSSED COVER FOR RING BINDER MECHANISM

[75] Inventor: Michael J. D'Amore, Lakevilla, Ill.

[73] Assignee: Acco World Corporation, Wheeling, Ill.

[21] Appl. No.: 544,778

[22] Filed: Jun. 27, 1990

[51] Int. Cl.[5] ..... B42F 13/00

[52] U.S. Cl. ..... 402/26; 402/37; 402/80 R; 402/80 L

[58] Field of Search ..... 402/26, 37, 80 R, 80 L, 402/31, 36, 38, 41

[56] References Cited

U.S. PATENT DOCUMENTS 3,191,604 6/1965 Wance .
3,246,652 4/1966 Lang ..... 402/37
3,306,301 2/1967 Mason ..... 402/80 L X
3,366,118 1/1968 Beyer .
3,591,300 7/1971 Beyer ..... 402/80 L
3,884,586 5/1975 Michaelis et al. ..... 402/38
4,813,803 3/1989 Gross ..... 402/38

FOREIGN PATENT DOCUMENTS 1101686 1/1968 United Kingdom ..... 402/80

*Primary Examiner*—Paul A. Bell
*Attorney, Agent, or Firm*—Pennie & Edmonds

[57] ABSTRACT

A punched sheet ring binder with configured ring halves, an arcuate mechanism cover with spaced apart platform surfaces to support the sheet border edges during operation of the binder.

4 Claims, 2 Drawing Sheets

EMBOSSED COVER FOR RING BINDER MECHANISM

BACKGROUND OF THE INVENTION

While ring binder mechanisms have used cover embosses for locking purposes (U.S. Pat. Nos. 4,813,803 and 3,884,586) and designers have varied the shape of ring halves for sheet control purposes, no fully satisfactory sheet control mechanism has yet been proposed.

SUMMARY OF THE INVENTION

Broadly, the present invention comprises platform embosses formed in the arcuate cover of a ring binder mechanism which embosses are located and shaped to lift and guide paper in the binder.

It is a feature that the paper in the ring binder is acted upon by the emboss platforms to support the paper, thus reducing and eliminating sheets of paper from becoming "bound" (or held) between the ring halves and the ring binder arcuate cover.

DESCRIPTION OF THE PREFERRED EMBODIMENT

Figure 1:
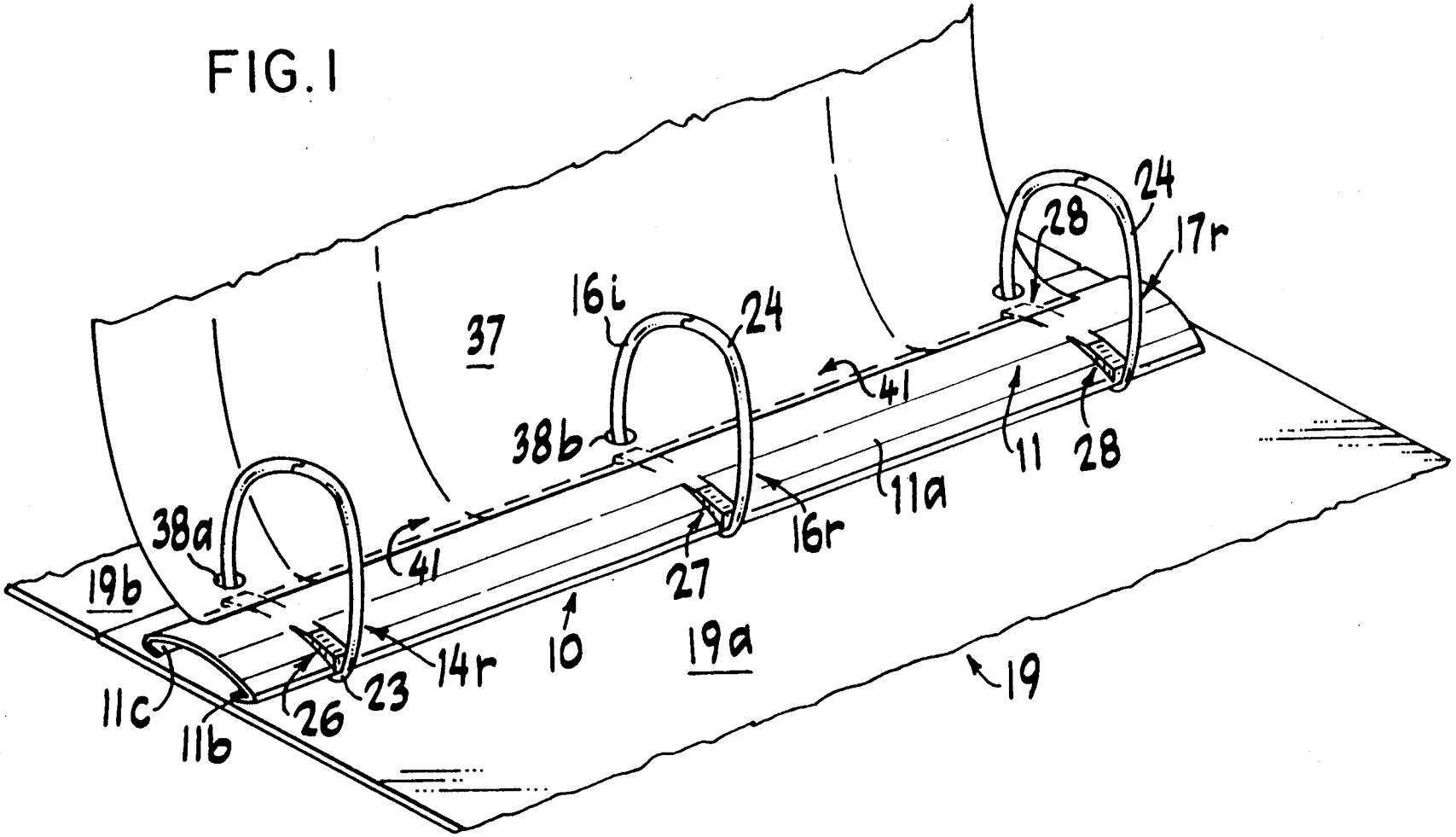
FIG. 1 is a perspective view of the ring mechanism attached to a binder cover.

In the Figures, ring mechanism 10 includes curved arcuate convex cover 11 including upper convex surface 11*a* and bendable legs 11*b*, 11*c*; toggle plates 12, 13 and ring halves 14, 16 and 17 each of which carry a designation (r) for right or (l) for left. The mechanism 10 is attached to binder outside cover 19 by rivets 21. Cover surface 11*a* is generally uniform through its length except for platform areas to be described hereafter. Cover 19 includes portions 19*a*, 19*b* and 19*c* hinged together.

Each ring half 14, 16 and 17 ((r) right and (l) left) is engaged to a toggle plate 12, 13. Each ring half consists of a portion 22 engaged at one end to a plate 12, 13 and extending outwardly, an elbow portion 23 and the remaining half ring being arcuate portion 24. Arcuate portion 24 is shaped to be positioned adjacent and close to platform surface 33 as further shown herein.

Figure 2:
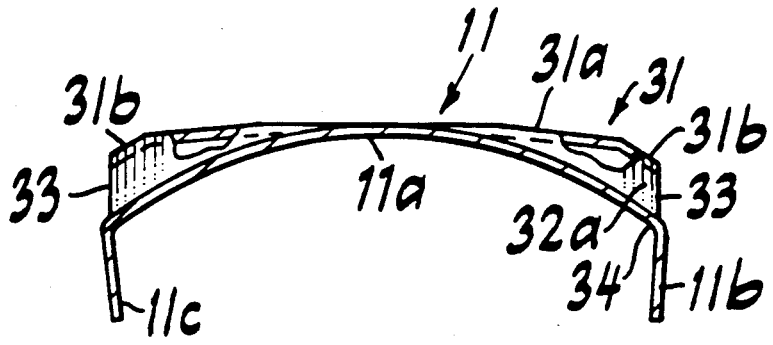
FIG. 2 is an enlarged sectional view along line 2—2 of FIG. 2 showing the curved cover plate during fabrication.

Positioned between each pair of ring halves 14, 16, 17 are pairs of spaced-apart raised platforms 26, 27 and 28 of cover 11. Each such raised platform is designated (r) for right or (l) for left. Each platform 26, 27, 28 includes a top surface 31 including substantially horizontal surface 31*a* and slanted surface 31*b*, two (2) vertical sides 32*a*, 32*b* and a vertical end 33. If desired surfaces 31*a* and 31*b* may be in the same plane at a slight angle to the horizontal. Platform ends 33 are slightly inboard of outer cover lip 34 edge (FIG. 2). Preferably platforms 26, 27, and 28 may be formed by embossing the cover surface 11*a* but other manufacture techniques are also contemplated.

Figure 3:
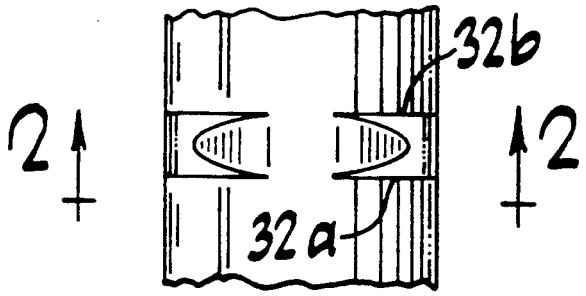
FIG. 3 is a partial plan view of the ring mechanism including cover plate during fabrication.

Turning to FIGS. 2 and 3, cover plate 11 is shown during manufacture with raised platform 27 formed therein but without legs 11*b*, 11*c* bent to final positions to accommodate plates 12, 13.

Figure 4:
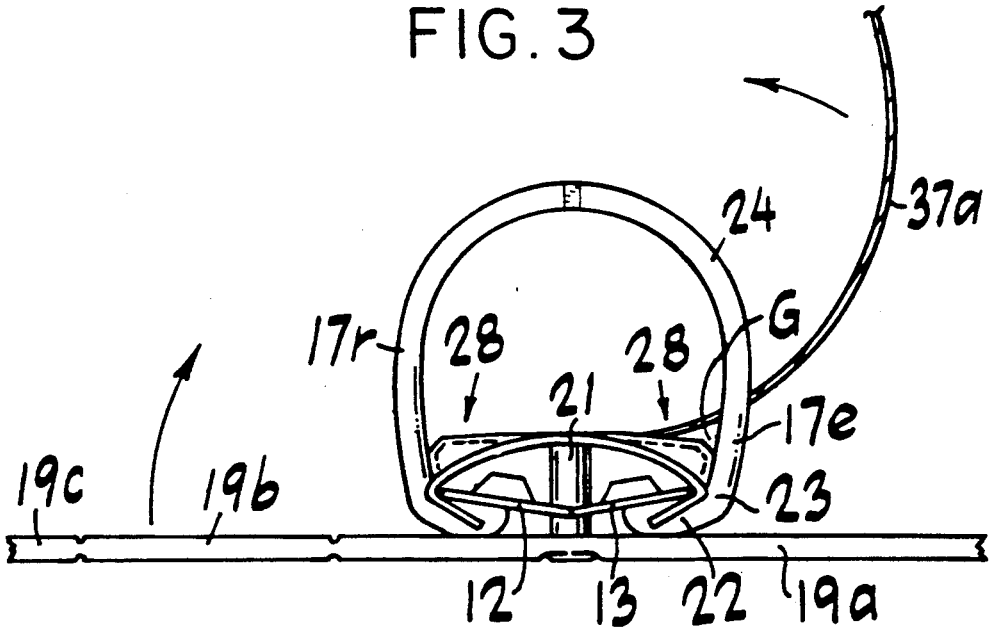
FIG. 4 is an end view of the assembled mechanism and binder.

With respect to FIGS. 1 and 4, sheet of paper 37 with punch holes 38*a–c* has border edge 41 adjacent holes 38*a–c* which border edge 41 rests on platforms 26, 27 and 28 to prevent such border edge 41 from becoming engaged between cover surface 11*a*, top surface 31 and an arcuate portion 24 of ring halves 14, 16 and 17. There is a small gap G between surface 31*b* and arcuate ring portion 24.

Paper sheet 37*a* is illustratively supported on platform 28, as the sheet 37*a* is caused to be moved upwardly toward the binder closed position (FIG. 4). Sheets are moved to a binder closed position by moving the cover portion 19*a* or 19*c* or otherwise.

I claim:

1. A punched sheet holding ring binder mechanism having a cover with an arcuate surface having a generally uniform surface extending throughout and the binder having pairs of ring halves which halves are movable from closed to open positions comprising a) a transverse paper supporting raised platform having a top surface which platform is connected to or integral with and positioned above the mechanism arcuate cover surface between a pair of ring halves, the surface comprising a right immovable surface and a left immovable surface; and b) a ring half which includes an arcuate portion which is adjacent the platform surface when the ring half is closed whereby a sheet in the binder cannot become engaged between the ring half and arcuate cover when the ring half is in the closed position.

2. The binder mechanism of claim 1 in which the binder has a plurality of pairs of ring halves and a platform surface between the ring halves of each pair.

3. The binder mechanism of claim 1 in which each ring half has an elbow portion and an arcuate portion.

4. A ring binder mechanism of claim 1 in which the platform has a substantial vertical end piece a selected distance from each of said rings.

* * * * *